US005960641A

United States Patent [19]

Kim et al.

[11] Patent Number: 5,960,641

[45] Date of Patent: Oct. 5, 1999

[54] COLD AIR CIRCULATION DEVICE OF REFRIGERATOR

[75] Inventors: Seok Ro Kim; Sang Bae Kim; Kyung Seok Yoon, all of Changwon, Rep. of Korea

[73] Assignee: LG Electronics Inc., Seoul, Rep. of Korea

[21] Appl. No.: 08/988,533

[22] Filed: Dec. 10, 1997

[30] Foreign Application Priority Data

| | | | |
|---|---|---|---|
| Dec. 28, 1996 | [KR] | Rep. of Korea | 96-59687 |
| Jun. 16, 1997 | [KR] | Rep. of Korea | 97-24804 |
| Aug. 29, 1997 | [KR] | Rep. of Korea | 97-42669 |

[51] Int. Cl.[6] ..... F25D 17/04

[52] U.S. Cl. ..... 62/407; 62/404; 62/408; 62/440; 62/441; 62/451; 62/443

[58] Field of Search ..... 62/404, 407, 408, 62/440, 441, 451, 443

[56] References Cited

U.S. PATENT DOCUMENTS 5,285,655 2/1994 Sung-Il et al. ..... 62/451

*Primary Examiner*—Henry Bennett
*Assistant Examiner*—Mark Shulman

[57] ABSTRACT

A cold air circulation device and method for a refrigerator, the refrigerator including a refrigerating compartment, a first door for providing access to the refrigerating compartment, a freezing compartment, a second door for providing access to the freezing compartment, and a cold air supply unit for supplying a cold air to the refrigerating and freezing compartments. The air circulation device and method include a first door duct formed within the first door, the first door duct including at least one inlet formed at a lower portion of the first door for receiving a circulated air from the refrigerating compartment, and an outlet formed at an upper portion of the first door for outputting the air from the inlet to the cold air supply unit.

20 Claims, 4 Drawing Sheets

COLD AIR CIRCULATION DEVICE OF REFRIGERATOR

BACKGROUND OF THE INVENTION

1. Field of the Invention

The present invention relates to a cold air circulation device of a refrigerator, and more particularly to a cold air circulation device for a refrigerator, which is capable of completely circulating the cold air in the refrigerating and freezing compartments of the refrigerator such that the cold air circulates even portions of the refrigerating and freezing compartments respectively disposed near the door of the refrigerating and freezing compartments, thereby uniformly supplying the cold air to the refrigerating and freezing compartments.

2. Description of the Background Art

Referring to FIG. 1, the configuration of a conventional refrigerator is illustrated. A cold air circulation in such a conventional refrigerator will now be described in conjunction with FIG. 1.

As shown in FIG. 1, the interior of the conventional refrigerator is divided into a freezing compartment 10 for storing foods in a frozen state and a refrigerating compartment 20 for storing foods in a refrigerated state. A barrier 30 divides the refrigerator into the freezing and refrigerating compartments 10 and 20. A foamed thermal insulator material is filled between an outer casing 2 of the refrigerator and inner casings 4*a* and 4*b* defining the interior of the refrigerator in order to prevent the interior of the refrigerator from performing a heat exchange operation with the exterior of the refrigerator. An evaporator 6 is disposed in the rear portion of the freezing compartment 10. In the rear portion of the freezing compartment 10, a fan 8 is also disposed to supply cold air generated by the evaporator 6 to the freezing and refrigerating compartments 10 and 20. A freezing compartment return duct 19 and a refrigerating compartment return duct 29 are provided in the barrier 30 to return the cold air circulating through the freezing and refrigerating compartments 10 and 20 back to the evaporator 6, respectively.

In order to open and close the freezing and refrigerating compartments 10 and 20, a freezing compartment door 12 and a refrigerating compartment door 22 are mounted on the front ends of the freezing and refrigerating compartments 10 and 20, respectively. A plurality of door baskets 14 and 24 are provided at the inner surfaces of the freezing and refrigerating compartment doors 12 and 22, respectively, in order to receive foods to be stored. A plurality of shelves 16 and 26 are separably mounted in the freezing and refrigerating compartments 10 and 20, respectively, in order to lay foods to be stored thereon.

Cold air circulation paths provided in such a conventional refrigerator configuration will be described.

Cold air, which is generated by the evaporator 6 in a contact manner, is supplied to the freezing and refrigerating compartments 10 and 20 by the fan 8. Introduction of the cold air into the freezing compartment 10 is carried out through a plurality of cold air inlets 18*a* formed at a grill 18 defining the rear surface of the freezing compartment 10. The cold air inlets 18*a* include upper cold air inlets 18*ab* open to an upper portion of the freezing compartment 10 formed above the freezing compartment shelf 16, and lower cold air inlets 18*ac* open to a lower portion of the freezing compartment 10 formed beneath the freezing compartment shelf 16.

The cold air introduced into the freezing compartment 10 through the cold air inlets 18*a* performs a heat exchange operation with the foods stored in the freezing compartment 10 while circulating the interior of the freezing compartment 10. As a result, the temperature of the circulating cold air increases to a relatively high temperature. The circulated air with the relatively high temperature then returns to the evaporator 6 via the freezing compartment return duct 19 having an inlet at the lower surface of the freezing compartment 10, in particular, near the freezing compartment door 12. This flow of cold air in the freezing compartment 10 is indicated by arrow in FIG. 1.

The above-described conventional cold air circulation configuration, however, has various drawbacks as follows.

As mentioned above, the cold air supplied from the evaporator 6 to the interior of the freezing compartment 10 flows back to the evaporator 6 via the freezing compartment return duct 19 having an inlet at the lower surface of the freezing compartment 10 near the freezing compartment door 12. However, the cold air does not flow through the freezing compartment door baskets 14 mounted to the inner surface of the freezing compartment door 12. In other words, the conventional cold air circulation configuration has a drawback in that an insufficient flow of cold air is provided at a portion of the freezing compartment 10 where the freezing compartment door baskets 14 are arranged, even though that portion of the freezing compartment 10 is first exposed to the ambient air of a relatively high temperature when the freezing compartment door 12 is opened.

Furthermore, since the inlet of the freezing compartment return duct 19 is arranged at the lower surface of the freezing compartment 10 near the freezing compartment door 12, it is impossible to provide a sufficient flow of cold air to the portion of the freezing compartment 10 facing the inlet of the freezing compartment return duct 19, i.e., to the upper portion 10*a* of the freezing compartment 10 (the dotted portion in FIG. 1) adjacent to the freezing compartment door 12.

The fact that the freezing compartment 10 includes the upper portion 10*a* or the like where an insufficient flow of cold air is provided indicates that the cold air is non-uniformly circulated throughout the entire freezing compartment 10. As a result, it is extremely difficult, if not impossible, to maintain a uniform freezing temperature throughout the entire freezing compartment 10. Consequently, foods stored in the freezing compartment 10 may spoil due to a temperature variation occurring within the freezing compartment 10.

In order to solve the above-described and other problems encountered in the conventional refrigerator, a technique has been proposed in which cold air ports are provided at the lower surface of each door basket mounted in the freezing compartment. However, the proposed configuration does not adequately address the problems. Although the cold air ports are provided at the lower surface of each door basket, they may be blocked by foods received in the door basket. For this reason, such cold air ports function insufficiently to remedy the problems. Furthermore, such cold air ports do not supply sufficient cold air to the upper portion 10*a* of the freezing compartment 10 disposed near the freezing compartment door 12.

The configuration of the refrigerating compartment 20 and a cold air circulation performed in the refrigerating compartment 20 will be described.

The cold air generated in accordance with the heat exchange operation of the evaporator 6 is partially guided to a refrigerating compartment duct 28 via a space defined between the grill 18 and a shroud 9 arranged in the rear portion of the grill 18. The cold air introduced in the refrigerating compartment duct 28 is then supplied to the refrigerating compartment 20 through a plurality of cold air inlets 28*a* formed at the front surface of the refrigerating compartment duct 28. The cold air inlets 28*a* are arranged such that they are open to different portions of the refrigerating compartment 20 partitioned by the shelves 26, respectively. The cold air supplied to the refrigerating compartment 20 performs a heat exchange operation with the foods stored in the refrigerating compartment 20 while circulating in the interior of the refrigerating compartment 20. As a result, the temperature of the circulating cold air increases to a relatively high temperature. The circulating air with the relatively high temperature then returns to the evaporator 6 via the refrigerating compartment return duct 29 having an inlet at the upper surface of the refrigerating compartment 20 near the refrigerating compartment door 22.

However, the above-mentioned cold air circulation configuration associated with the refrigerating compartment 20 has drawbacks similar to those involved in the cold air circulation configuration associated with the freezing compartment 10.

In the refrigerating compartment 20, an insufficient flow of cold air is supplied to a portion of the refrigerating compartment 20 where the refrigerating compartment door baskets 24 are arranged. As a result, the temperature near the door basket portion of the refrigerating compartment 20 is maintained at a relatively high value as compared to other portions of the refrigerating compartment 20.

The refrigerating compartment 20 is frequently opened and closed, perhaps more than the freezing compartment 10. For this reason, an ambient air of high temperature can enter the refrigerating compartment 20 more frequently. Certain portions of the refrigerating compartment 20, where the door baskets 24 are disposed, are easily exposed to the high-temperature, ambient air. Accordingly, an increased amount of cold air need to be supplied to such door basket portions of the refrigerating compartment 20 to maintain a cool temperature.

Further, in the above-mentioned conventional configuration, a limited cold air circulation is obtained. Such a limited cold air circulation results in a difficulty in maintaining a set freezing or refrigerating temperature. Consequently, there is a major problem of spoiling foods stored in the refrigerator.

SUMMARY OF THE INVENTION

Therefore, an object of the invention is to provide a cold air circulation device for a refrigerator, which is capable of sufficiently circulating cold air throughout the entire refrigerator, thereby obtaining uniform temperature distribution respectively within the freezing and refrigerating compartments of the refrigerator.

Another object of the invention is to provide a cold air circulation device for a refrigerator, which is capable of effectively supplying cold air to certain portions of the freezing and refrigerating compartments respectively disposed near associated doors.

In accordance with the present invention, these and other objects are accomplished by providing a cold air circulation device of a refrigerator comprising a storage compartment defined in the interior of the refrigerator and adapted to store articles therein; a door adapted to open and close the storage compartment; cold air supply means for supplying cold air to the storage compartment; a return path open to a desired portion of the storage compartment and adapted to return the cold air circulating in the storage compartment; and a cold air guide path adapted to guide the cold air supplied in the storage compartment to the return path. In accordance with this configuration, in the storage compartment such as a freezing or refrigerating compartment, a flow of cold air passes over/under a portion of the storage compartment disposed near a door for the storage compartment. That is, a flow of cold air passes over/under a door basket mounted at the compartment door. Accordingly, it is possible to effectively supply cold air to the portions of the compartment disposed near the compartment door.

Where the storage compartment is a freezing compartment, the cold air guide path comprises a door duct formed in a door of the freezing compartment in accordance with an embodiment of the present invention. The door duct comprises an inlet arranged at an upper portion of the freezing compartment, and an outlet arranged at a lower portion of the freezing compartment, the outlet communicating with the inlet. Accordingly, the cold air flows from the upper portion of the freezing compartment to the lower portion of the freezing compartment in the vicinity of the freezing compartment door. In particular, an effective flow of cold air is provided in the upper portion of the freezing compartment in the vicinity of the freezing compartment door.

In accordance with another embodiment of the present invention, the cold air guide path comprises a detachable door duct attached to an inner surface of a door of the storage compartment. In this case, it is possible to provide an effective flow of cold air without greatly modifying conventional constructions.

The inlet of the door duct is arranged such that the cold air, which is introduced into the inlet, circulates around a door basket mounted to an inner surface of the door of the storage compartment near an upper end of the door prior to the introduction thereof. Accordingly, foods stored in the door baskets are exposed to the cold air supplied in sufficient amount.

In accordance with another embodiment of the present invention, if the storage compartment is a refrigerating compartment, the cold air guide path is adapted to form a flow of cold air around the door of the refrigerating compartment between upper and lower portions of the refrigerating compartment. The cold air guide path comprises a door duct formed in the refrigerating compartment door, the door duct having an outlet formed at an upper portion of the door duct and a plurality of inlets formed at a lower portion of the door duct. The inlets of the door duct are arranged such that the cold air, which is introduced into the inlets, circulates around a plurality of door baskets mounted to an inner surface of the refrigerating compartment door prior to the introduction thereof. Accordingly, it is possible to sufficiently supply cold air to the portions of the refrigerating compartment disposed near the refrigerating compartment door.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed descriptions.

BRIEF DESCRIPTION OF THE DRAWINGS

Other objects and aspects of the invention will become apparent from the following description of the preferred embodiments of the present invention with reference to the accompanying drawings, in which.

DETAILED DESCRIPTION OF THE PREFERRED EMBODIMENTS

Figure 2:
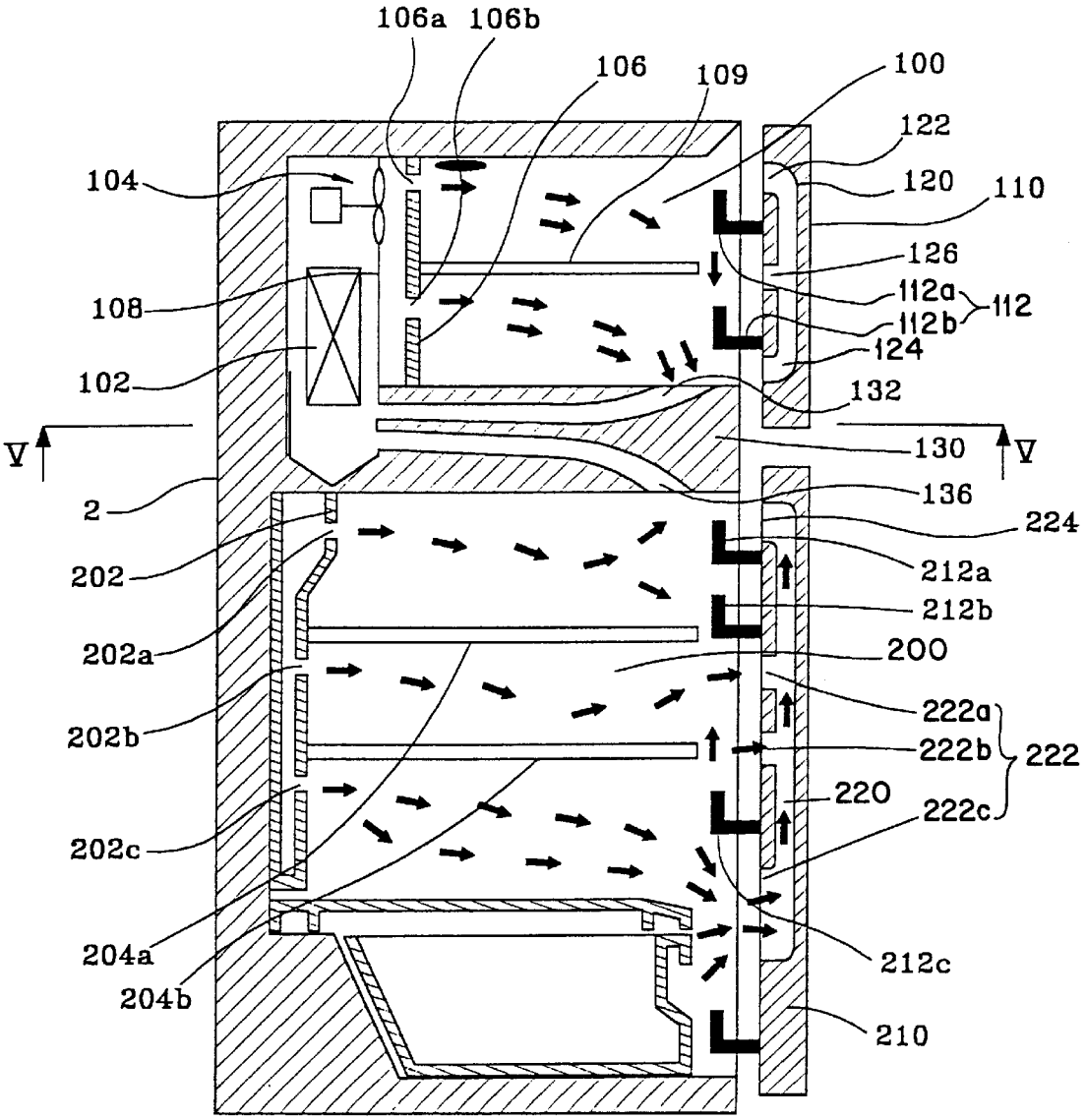
FIG. 2 is a sectional view illustrating a cold air circulation device of a refrigerator in accordance with an embodiment of the present invention.

Referring to FIG. 2, a cold air circulation device of a refrigerator according to an embodiment of the present invention is illustrated. First, the entire construction of the freezing compartment of the refrigerator and the cold air circulation configuration for the freezing compartment will be described in conjunction with FIG. 2.

In the freezing compartment 100 of the refrigerator as shown in FIG. 2, a freezing compartment shelf 109 is horizontally mounted to lay foods thereon. A plurality of cold air inlets 106*a* and 106*b* are formed at a grill, which defines a rear surface of the freezing compartment 100. The cold air inlets include upper cold air inlets 106*a* open to an upper portion of the freezing compartment 100, and lower cold air inlets 106*b* open to a lower portion of the freezing compartment 100. The upper and lower portions of the freezing compartment 100 are defined by the freezing compartment shelf 109. The cold air inlets 106*a* and 106*b* serve to guide the cold air into the freezing compartment 100. The cold air is generated by an evaporator 102 in a contact manner or the like.

In accordance with the embodiment of the present invention, a vertically-extending door duct 120 is provided in a freezing compartment door 110 adapted to provide access to the freezing compartment 100. The door duct 120 has an inlet 122 and an outlet 124 both communicating with the interior of the freezing compartment 100. That is, the door duct 120 allows a portion of a cold air circulation path to be established in the interior of the freezing compartment 100. The inlet 122 of the door duct 120 communicates with the upper portion of the freezing compartment 100 whereas the outlet 124 of the door duct 120 communicates with the lower portion of the freezing compartment 100. Thus, the cold air circulates within the interior of the freezing compartment 100 via the door duct 120.

Figure 5:
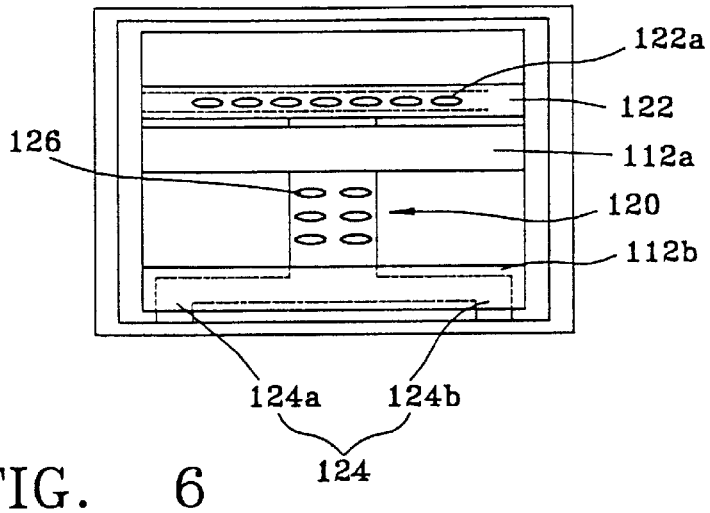
FIG. 5 is an elevational view illustrating the inner surface of a freezing compartment door in accordance with an embodiment of the present invention.

The inlet 122 provided at the upper portion of the freezing compartment door duct 120 is adapted to provide a sufficient flow of cold air in the vicinity of a door basket 112*a* arranged at an upper portion of the inner surface of the freezing compartment door 110. As shown in FIG. 2, it is desirable for the inlet 122 of the freezing compartment door duct 120 to be arranged adjacent to the door basket 112*a*. As shown in FIG. 5, the inlet 122 of the freezing compartment door duct 120 includes a plurality of cold air ports 122*a* formed at the freezing compartment door duct 120 nearest the door basket 112*a*. Accordingly, when a cold air is introduced into the freezing compartment 100, it passes the door basket 112*a*. As a result, a sufficient flow of cold air is provided even in the vicinity of the portion of the freezing compartment 100 where the door basket 112*a* is arranged.

Figure 3:
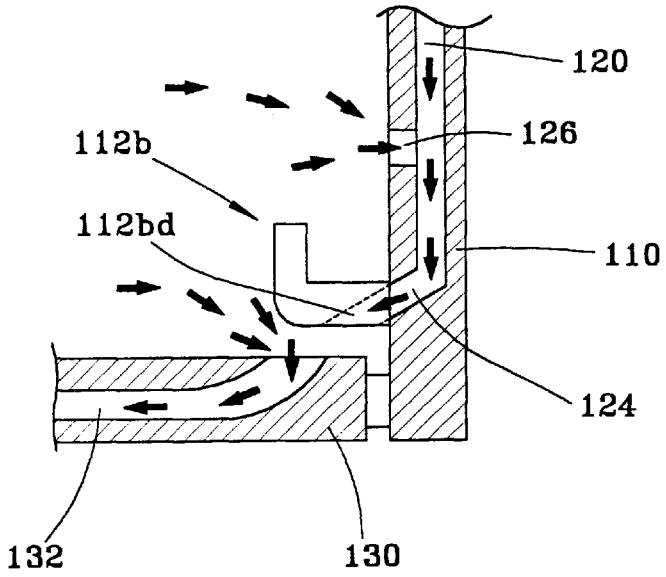
FIG. 3 is an enlarged view of a portion of FIG. 2.

The outlet 124 of the door duct 120 is arranged at the lower portion of the freezing compartment door 110 where the inlet of a freezing compartment return duct 132 is arranged. Accordingly, the cold air introduced into the door duct 120 can enter the freezing compartment return duct 132 via the outlet 124 of the door duct 120. In other words, it is desirable for the cold air emerging from the outlet 124 to directly return to the evaporator 102 via the freezing compartment return duct 132 provided in the barrier 130. In particular, in the illustrated case as shown in FIG. 3 in which the door basket 112*b* is arranged at a lower portion of the inner surface of the freezing compartment door 110, it may be possible to configure the door duct 120 so that its outlet 124 communicates directly with the freezing compartment return duct 132 through a connecting duct 112*bd* provided at the door basket 112*b*.

Figure 4:
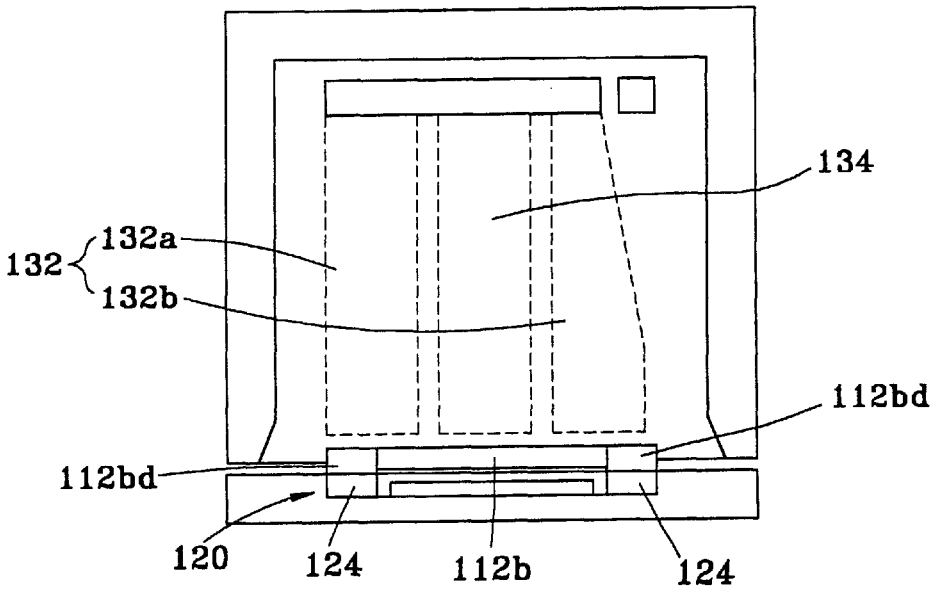
FIG. 4 is a cross-sectional view of FIG. 2 along line A—A.

Configurations of the outlet 124 of the freezing compartment door duct 120 and freezing compartment return duct 132 will now be described in conjunction with FIGS. 4 and 5.

As shown in FIG. 5, the outlet 124 of the freezing compartment door duct 120 includes a pair of laterally spaced outlets 124*a* and 124*b*. The freezing compartment return duct 132, which serves to return the cold air discharged from the outlets 124*a* and 124*b* of the freezing compartment door duct 120, includes a pair of laterally spaced ducts 132*a* and 132*b* respectively facing the outlets 124*a* and 124*b* at their outlets. The freezing compartment return ducts 132*a* and 132*b* are formed in portions of the barrier 130 laterally opposite to each other, respectively. In FIG. 4, reference numeral 134 denotes a refrigerating compartment return duct formed in the barrier 130 between the freezing compartment return ducts 132*a* and 132*b*.

In accordance with the illustrated embodiments of the present invention, the inlet 122 of the freezing compartment door duct 120 is arranged adjacent to the upper door basket 112*a* mounted at the upper portion of the freezing compartment door 110 whereas the outlet 124 of the freezing compartment door duct 120 is arranged adjacent to the lower door basket 112*b* mounted at the lower portion of the freezing compartment door 110. In order to provide a more effective flow of cold air in the portion of the freezing compartment 100 disposed in the vicinity of the middle portion of the freezing compartment door duct 120, the freezing compartment door duct 120 is provided at its middle portion with a plurality of cold air ports 126 to provide air flow between the freezing compartment 100 and the freezing compartment door duct 120, as shown in FIG. 5. The cold air ports 126 are arranged between the upper and lower door baskets 112*a* and 112*b*. By virtue of the cold air ports 126, the circulation of cold air in the portions of the freezing compartment 100 disposed near the freezing compartment door 110 is more effectively obtained. That is, the cold air circulates effectively between the upper and lower door baskets 112*a* and 112*b* through the cold air ports 126. Thus, a sufficient flow of cold air is supplied to the portions of the freezing compartment 100 disposed near the door baskets 112.

Now, a cold air circulation carried out in the freezing compartment 100 base on the above-mentioned configuration will be described.

Cold air, which is generated in accordance with a heat exchange operation performed by the evaporator 102 arranged in the rear portion of the freezing compartment 100, is supplied to the freezing compartment 100 by a fan 104. A flow of cold air generated by the fan 104 is introduced into the upper and lower portions of the freezing compartment 100 separated by the freezing compartment shelf 109 through the upper and lower cold air inlets 106*a* and 106*b* formed at the grill 106, respectively.

Figure 1:
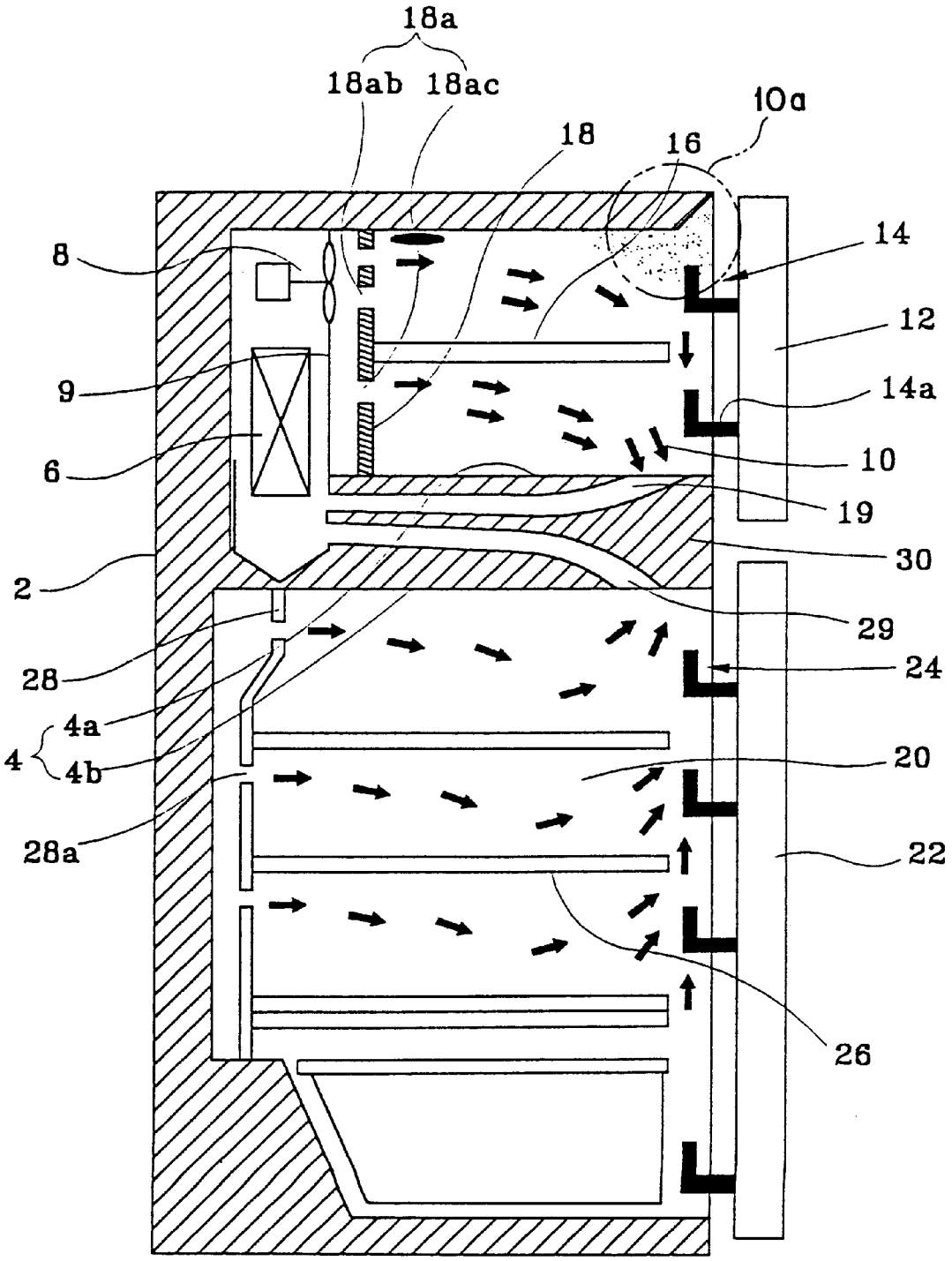
FIG. 1 (CONVENTIONAL ART)
FIG. 1 is a sectional view illustrating the configuration of a conventional refrigerator and its cold air circulation configuration.

Through the inlet 106*a*, the cold air supplied to the upper portion of the freezing compartment 100 above the freezing compartment shelf 109 moves forward towards the freezing compartment door 110 and carries out a heat exchange operation with the foods stored in the upper portion of the freezing compartment 100. The cold air reaches the freezing compartment door 110 and then enters the inlet 122 of the door duct 120 formed in the freezing compartment door 110. Since the inlet 122 of the door duct 120 is arranged near the upper end of the freezing compartment door 110, an effective flow of cold air can be formed at the portions of the freezing compartment 100 disposed near the upper end of the freezing compartment door 110. This means that a sufficient amount of cold air is supplied to the portions of the freezing compartment 100 disposed near the upper end of the freezing compartment door 110. Accordingly, there is no area, such as the dotted area 10*a* in FIG. 1, where the cold air is stagnant. It is possible to uniformly supply cold air throughout the entire freezing compartment 100.

Through the lower inlet 106*b*, the cold air supplied to the lower portion of the freezing compartment 100 disposed beneath the freezing compartment shelf 109 moves forward towards the freezing compartment door 110 and performs a heat exchange operation with the foods stored in the lower portion of the freezing compartment 100. Then the circulating cold air enters the freezing compartment return duct 132 formed in the barrier 130.

Meanwhile, the cold air introduced into the door duct 120 through the inlet 122 formed at the upper portion of the door duct 120 moves downwardly through the door duct 120. The cold air, which has carried out a heat exchange operation with the foods stored in the freezing compartment 100 while moving forward within the freezing compartment 100 in the vicinity of the freezing compartment shelf 109, also enters the door duct 120 through the cold air ports 126 formed at the middle portion of the door duct 120. This flow of cold air then moves downwardly through the door duct 120. Such flows of cold air are indicated by arrows in FIG. 3. The cold air in the door duct 120 reaching the lower end of the door duct 120 is partially discharged from the door duct 120 through the outlet 124 of the door duct 120. This cold air is also partially discharged from the door duct 120 via the connecting duct 112*bd* if it is formed at the lower door basket 112*b*. Thus, the cold air is introduced into the freezing compartment return duct 132 formed in the barrier 130.

As described above, in accordance with this embodiment of the present invention, the flow of cold air circulating in the freezing compartment 100 includes the flow of cold air circulating through the door duct 120. In other words, the cold air supplied to the upper portion of the freezing compartment 100 performs a heat exchange operation while moving forwardly beneath the freezing compartment shelf 109, and then enters the inlet 122 of the door duct 120 formed in the freezing compartment door 110. The cold air introduced in the door duct 120 moves downwardly through the door duct 120 and then emerges from the door duct 120 through the outlet 124 so that it is introduced into the freezing compartment return duct 132, immediately.

On the other hand, the cold air supplied to the lower portion of the freezing compartment 100 performs a heat exchange operation while moving forwardly beneath the freezing compartment shelf 109, and then directly enters the freezing compartment return duct 132. Since the cold air ports 126 are provided at the middle portion of the door duct 120, the cold air flowing in the middle portion of the freezing compartment 100 also enters the freezing compartment duct 120.

In accordance with such a cold air circulation in the freezing compartment 100, a flow of cold air enters the door duct 120 at the portions of the freezing compartment 100 disposed near the freezing compartment door 110. In other words, a separate flow of cold air enter the door duct 120 after passing through each of the door baskets 112*a* and 112*b*. Accordingly, a sufficient amount of cold air is supplied to certain portions of the freezing compartment 100 disposed adjacent to the door baskets 112*a* and 112*b*, e.g., to the upper portion of the freezing compartment 100 near the freezing compartment door 110.

A cold air circulation configuration of the refrigerating compartment in accordance with the present invention will now be described in conjunction with FIG. 2.

In accordance with this embodiment of the present invention, the refrigerating compartment 200 includes a refrigerating compartment duct 202 adapted to supply cold air to the refrigerating compartment 200, and a refrigerating compartment door duct 220 formed in a refrigerating compartment door 210 and adapted to guide the cold air introduced in the refrigerating compartment duct 202 to a refrigerating compartment return duct 136 formed in the barrier 130.

The refrigerating compartment duct 202 communicates with the space defined between the grill 106 and shroud 108, so that it receives the cold air generated in accordance with a heat exchange carried out by the evaporator 102 and guides the cold air to the refrigerating compartment 200. The cold air introduced in the refrigerating compartment duct 202 is supplied to the refrigerating compartment 200 through a plurality of cold air inlets 202*a*, 202*b* and 202*c* formed at the front surface of the refrigerating compartment duct 202.

The cold air inlets 202*a*, 202*b* and 202*c* are arranged in such a manner so that they are open to different portions of the refrigerating compartment 200 partitioned by refrigerating compartment shelves 204*a* and 204*b* mounted in the refrigerating compartment 200, respectively. Accordingly, cold air can be supplied to the entire refrigerating compartment 200.

The refrigerating compartment door duct 220, which is formed in the refrigerating compartment door 210, serves to upwardly move the cold air circulating in the refrigerating compartment 200, thereby returning the cold air to the refrigerating compartment return duct 136. As shown in FIG. 2, the refrigerating compartment door duct 220 extends vertically throughout the vertical length of the refrigerating compartment door 210. The refrigerating compartment door duct 220 is provided at its lower portion with a plurality of vertically spaced inlets 222*a*, 222*b* and 222*c* (222) for directing the cold air circulating in the refrigerating compartment 200 into the door duct 220. The cold air entering the refrigerating compartment door duct 220 via the inlets 222 moves upwardly through the door duct 220 and emerges from the door duct 220 through an outlet 224 formed at the door duct 220. The outlet 224 is arranged adjacent to the refrigerating compartment return duct 136 so that the cold air discharged from the outlet 224 is introduced immediately into the refrigerating compartment return duct 136.

A plurality of vertically spaced door baskets 212*a*, 212*b* and 212*c* are mounted to the inner surface of the refrigerating compartment door 210 to store foods thereon. It is desirable to arrange the cold air inlets 222*a*, 222*b* and 222*c* adjacent to the door baskets 212*a*, 212*b* and 212*c*, respectively. In this case, the cold air introduced into the cold air inlets 222*a*, 222*b* and 222*c* after circulating in the refrigerating compartment 200 passes the door baskets 212*a*, 212*b* and 212*c*, so that the sufficient amount of cold air comes into contact with the foods stored in the door baskets 212*a*, 212*b* and 212*c*.

Now, a cold air circulation carried out in the refrigerating compartment 200 by the above-mentioned configuration according to the present invention will be described.

Cold air, which is generated in accordance with a heat exchange carried out by the evaporator 102, is guided to the refrigerating compartment duct 202 communicating with the space defined between the grill 106 and shroud 108. The cold air introduced in the refrigerating compartment duct 202 is then supplied to the interior of the refrigerating compartment 200 through a plurality of cold air inlets 202*a*, 202*b* and 202*c* formed at the front surface of the refrigerating compartment duct 202.

The cold air supplied to the refrigerating compartment 200 performs a heat exchange operation with the foods stored in the refrigerating compartment 200 while moving forward towards the refrigerating compartment door 210. The circulating air is then guided to the portions of the refrigerating compartment 200 disposed near the refrigerating compartment door baskets 212*a*, 212*b* and 212*c*, so that it enters the refrigerating compartment door duct 220 through the inlets 222. Since the cold air introduced into the refrigerating compartment door duct 220 through the inlets 222 passes the door baskets 212*a*, 212*b* and 212*c*, a sufficient amount of cold air contacts the foods stored in the door baskets. A flow of cold air from the rear portion of the refrigerating compartment 200 in the direction of the refrigerating compartment door baskets is also established. Accordingly, it is possible to sufficiently supply cold air to the portions of the refrigerating compartment 200 disposed adjacent to the refrigerating compartment door 210.

The cold air introduced in the refrigerating compartment door duct 220 moves upwardly through the door duct 220. This cold air includes flows of cold air respectively introduced from the lower and middle portions of the refrigerating compartment 200 through the inlets 222*a*, 222*b* and 222*c*. The cold air is then discharged from the refrigerating compartment door duct 220 through the outlet 224 arranged at the upper end of the door duct 220. Since the outlet 224 of the refrigerating compartment door duct 220 is arranged in the vicinity of the inlet of the refrigerating compartment duct 136 formed in the barrier 130, the cold air emerging from the outlet 224 directly enters the refrigerating compartment return duct 136 and returns to the evaporator 102. The cold air completing the above-mentioned circulation comes into contact with the evaporator 102 again, so that it is cooled to a desired low temperature. This process is repeatedly and continuously performed to provide a sufficient amount of cold air to the compartments 100 and 200. The cold air supplied to the upper portion of the refrigerating compartment 200 may be directly guided to the refrigerating compartment return duct 136 without passing through the refrigerating door duct 220.

As apparent from the above description, in the cold air circulation configuration for the refrigerating compartment according to this embodiment of the present invention, the cold air supplied to the refrigerating compartment 200 via the refrigerating compartment duct 202 moves upwardly through the refrigerating compartment door duct 220 formed in the refrigerating compartment door 210, and returns to the refrigerating compartment return duct 136. In this case, the cold air returning via the refrigerating compartment door duct 220 passes over/under the refrigerating compartment door baskets 212*a*, 212*b* and 212*c* mounted at the inner surface of the refrigerating compartment door 210 prior to its introduction into the door duct 220.

In other words, in the refrigerating compartment 200, effective flows of cold air, which enter the door duct 120 after passing through the door baskets 212*a*, 212*b* and 212*c*, respectively, exist. Accordingly, a sufficient amount of cold air is supplied to the portions of the refrigerating compartment 200 respectively disposed adjacent to the door baskets 212*a*, 212*b* and 212*c*. Thus, it is possible to uniformly supply cold air throughout the entire refrigerating compartment 200.

Figure 6:
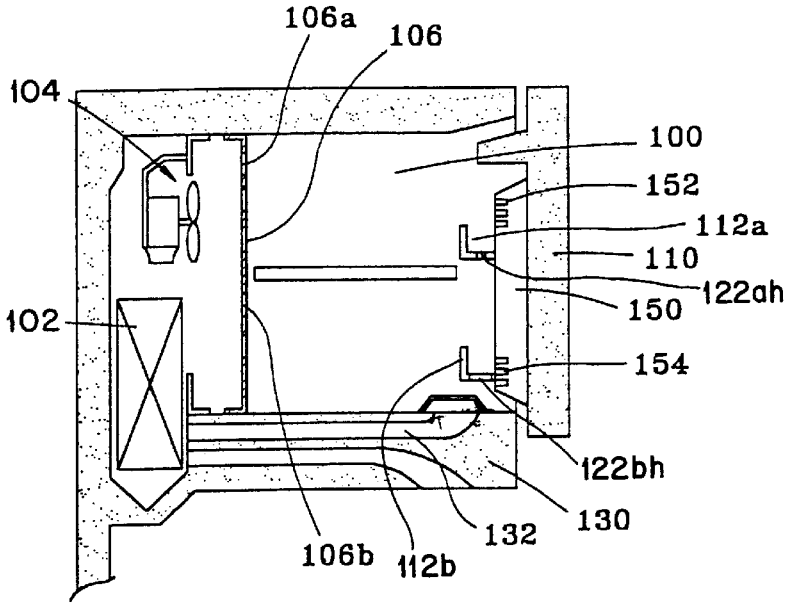
FIG. 6 is a sectional view illustrating a cold air circulation device of a refrigerator in accordance with another embodiment of the present invention.
Figure 7:
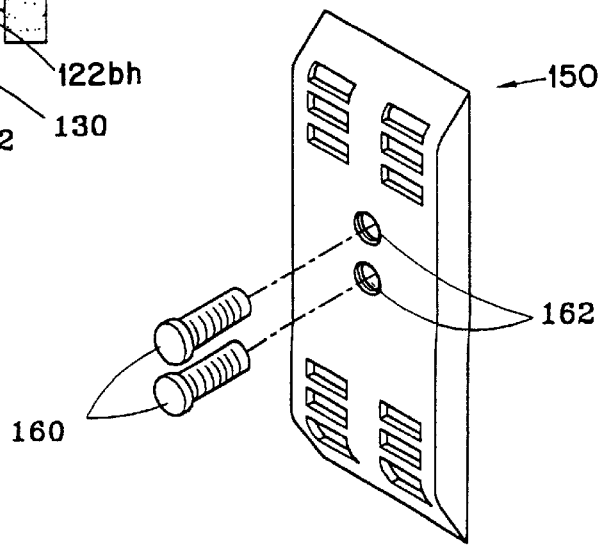
FIG. 7 is a perspective view illustrating a detachable door duct according to the embodiment of FIG. 6.

FIGS. 6 and 7 illustrate different views of a cold air circulation device of a refrigerator according to another embodiment of the present invention. This embodiment is adapted to provide a cold air circulation to a portion of the freezing compartment disposed near the freezing compartment door without greatly modifying the construction of the freezing compartment door.

In accordance with the embodiment of the present invention, a separate door duct is mounted to the inner surface of the freezing compartment door, this door duct being different from the door duct of FIGS. 2 to 5 formed in the freezing compartment door. In this embodiment, it is possible to provide the cold air circulation in accordance with the present invention without a significant modification in construction.

In FIGS. 6 and 7, elements respectively corresponding to those in FIGS. 2 to 5 are denoted by the same reference numerals.

In accordance with the embodiment of the present invention, a detachable door duct 150 is attached to the inner surface of the freezing compartment door 110 to form flow paths for the cold air to pass over/under the door baskets 112*a* and 112*b*.

As shown in FIG. 7, the detachable door duct 150, which is formed using a mold material, plastic, etc., is provided at its upper end with inlets 152 and at its lower end with outlets 154.

The detachable door duct 150 is attached to the inner surface of the freezing compartment door 110 using fixing members 160. The fixing members 160, e.g., fixing bolts, nuts, etc., are inserted through clamping holes 162 respectively formed through the middle portion of the door duct 150 and through the corresponding portion of the freezing compartment door 110. The attachment of the door duct 150 to the freezing compartment door 110 may also be achieved using other mounting means, e.g., clamps, glue, tape.

Since the inlets 152 of the detachable door duct 150 are arranged at the upper end of the door duct 150, namely, the upper portion of the freezing compartment door 110, an effective flow of cold air is provided in the portions of the freezing compartment 100 near the upper portion of the freezing compartment door 110. In contrast, cold air is stagnant in a freezing compartment portion of the conventional refrigerator.

The outlets 154 of the door duct 150 are arranged in the vicinity of the inlet of the freezing compartment return duct 132 formed in the barrier 130. Thus, the detachable door duct 150 is adapted to provide an effective /sufficient flow of cold air in the upper portion of the freezing compartment 100 in the vicinity of the freezing compartment door baskets 112.

Now, a cold air circulation carried out in the above-mentioned configuration according to the embodiment of the present invention will be described.

Cold air, which is generated in accordance with a heat exchange carried out by the evaporator 102 in a contact manner, is supplied to the freezing compartment 100 by the fan 104. The cold air introduced into the freezing compartment 100 through cold air inlets 106*a* and 106*b* formed in the grill 106 defining the rear surface of the freezing compartment 100 moves forward in the freezing compartment 100. The cold air may carry out a heat exchange with foods stored in the freezing compartment 100 while moving forward.

The cold air supplied to the upper portion of the freezing compartment 100 disposed above the freezing compartment shelf 109 through the upper cold air inlet 106*a* moves forward towards the freezing compartment door 110 and then enters partially the inlets 152 of the detachable door duct 150.

The remaining cold air, not entering the detachable door duct 150, passes downwardly through holes 122*ah* and 122*bh* respectively formed in the bottom surfaces of the door baskets 112*a* and 112*b*. The cold air introduced into the detachable door duct 150 is discharged from the door duct 150 through the outlets 154 formed at the lower end of the door duct 150. The discharged cold air is then introduced into the freezing compartment return duct 132.

The cold air supplied through the lower cold air inlet 106*b* to the lower portion of the freezing compartment 100 moves forward towards the freezing compartment door 110 and performs a heat exchange operation with the foods stored in the lower portion of the freezing compartment 100. The cold air then enters the freezing compartment return duct 132 having an inlet arranged at the front portion of the barrier 130. The cold air introduced in the freezing compartment return duct 132 is guided to the evaporator 102, which, in turn, cools the air to a desired low temperature. This process is repeatedly and continuously carried out to supply a sufficient amount of cold air to the compartments 100 and 200.

As described above, in accordance with the embodiment of the present invention, in the freezing compartment 100, flows of cold air, which pass over and under the door baskets 112*a* and 112*b*, exist. In particular, as the inlets of the door duct 150 are arranged at the upper portion of the freezing compartment 100 in the vicinity of the freezing compartment door 110, an effective cold air circulation is provided in that freezing compartment portion. Accordingly, the freezing compartment 100 exhibits a uniform temperature distribution throughout the entire portion thereof. The door duct 150 is simply attachable to the freezing compartment door having a conventional construction.

As apparent from the above description, the present invention provides various advantages, as follows.

In accordance with the embodiments of the present invention, it is possible to provide an effective flow of cold air in portions of the freezing or refrigerating compartment disposed near an associated compartment door. That is, flows of cold air, which pass over and under the door baskets mounted to each compartment door, are established. In other words, the freezing or refrigerating compartment has no portion where the cold air is stagnant. Accordingly, an effective and uniform flow of cold air is provided throughout the entire freezing and/or refrigerating compartment.

In the case of a freezing compartment, a cold air circulation path is formed to downwardly circulate the cold air from the upper end of the freezing compartment near the freezing compartment door. Accordingly, an effective flow of cold air is provided in the upper portion of the freezing compartment near the freezing compartment door.

Since flows of cold air passing over and under the door baskets exist in the freezing and refrigerating compartments, effective flows of cold air are provided in the portions of those compartments respectively disposed near the associated doors. Accordingly, a sufficient amount of cold air is supplied to the compartment portions, which are disposed near the associated doors and easily subjected to an increase in the temperature due to a frequent door opening. Consequently, it is possible to store foods in a more fresh state in the present invention.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A cold air circulation device of a refrigerator, comprising:

a storage compartment defined in the interior of the refrigerator and adapted to store articles therein;

a door adapted to open and close the storage compartment;

a cold air supply unit adapted to supply cold air to the storage compartment;

a cold air guide path, defined by a door duct formed within the door, for guiding the cold air supplied in the storage compartment to a return path; and the return path, defined through a portion of the refrigerator, for returning the cold air received from the cold air guide path back to the cold air supply unit.

2. The cold air circulation device in accordance with claim 1, wherein the storage compartment is a freezing compartment, and the cold air guide path is defined by the a door duct formed in the door for the freezing compartment.

3. The cold air circulation device in accordance with claim 1, wherein the door duct comprises an inlet arranged at an upper portion of the door, and an outlet arranged at a lower portion of the door, the outlet communicating with the inlet.

4. The cold air circulation device in accordance with claim 3, wherein the inlet of the door duct is arranged above a door basket mounted to an inner surface of the door.

5. The cold air circulation device in accordance with claim 3, wherein the outlet of the door duct is arranged in the vicinity of an inlet of the return path.

6. The cold air circulation device in accordance with claim 5, wherein the outlet of the door duct communicates with the return path through a bottom portion of a door basket mounted to an inner surface of the door.

7. The cold air circulation device in accordance with claim 5, wherein the outlet of the door duct comprises a pair of laterally spaced outputs, and the return path is defined by a pair of return ducts corresponding to the laterally spaced outputs.

8. The cold air circulation device in accordance with claim 1, wherein the cold air guide path is also provided at a middle portion of the door with a plurality of cold air ports formed at the middle portion of the door.

9. The cold air circulation device in accordance with claim 2, wherein the storage compartment is a refrigerating compartment.

10. The cold air circulation device in accordance with claim 9, wherein the cold air guide path is defined by the door duct formed within the door for the refrigerating compartment, the door duct having an inlet and an outlet communicating with an upper or lower portion of the refrigerating compartment.

11. The cold air circulation device in accordance with claim 10, wherein the outlet of the door duct is arranged in the vicinity of an inlet of the return path.

12. The cold air circulation device in accordance with claim 11, wherein the inlet of the door duct comprises a plurality of inlets holes formed in a lower portion of the door duct.

13. The cold air circulation device in accordance with claim 12, wherein the inlet holes of the door duct are arranged so that cold air, which is introduced into the inlet holes, passes over and under a plurality of door baskets mounted to an inner surface of the refrigerating compartment door prior to being introduced into the inlet holes.

14. A cold air circulation device for a refrigerator, the refrigerator including a refrigerating compartment, a first door for providing access to the refrigerating compartment, a freezing compartment, a second door for providing access to the freezing compartment, and a cold air supply unit for supplying a cold air to the refrigerating and freezing compartments, the circulation device comprising:

a first door duct formed within the first door, the first door duct including at least one inlet formed at a lower portion of the first door for receiving a circulated air from the refrigerating compartment, and an outlet formed at an upper portion of the first door for outputting the air from said at least one inlet to the cold air supply unit.

15. The cold air circulation device of claim 14, wherein the circulated air, input through said at least one inlet of the first door duct, travels upwardly through the first door duct, and is output through the outlet of the first door duct towards the cold air supply unit.

16. The cold air circulation device of claim 14, wherein the refrigerator further includes a division unit for separating the freezing and refrigerating compartments, the division unit including a return duct for directing the air output from the outlet of the first door duct directly to the cold air supply unit.

17. The cold air circulation device of claim 14, further comprising:

a second door duct formed within the second door, the second door duct comprising an inlet formed at an upper portion of the second door, and an outlet formed at a lower portion of the second door, the inlet of the second door duct receiving a circulated air from the freezing compartment and the outlet of the second door duct outputting the air from the inlet to the cold air supply unit.

18. The cold air circulation device of claim 17, wherein the refrigerator further includes a division unit for separating the freezing and refrigerating compartments, the division unit including a return duct for directing the air from the outlet of the second door duct directly to the cold air supply unit.

19. The cold air circulation device of claim 18, wherein the refrigerator further includes a plurality of shelves mounted on an inner surface of the second door, one of the shelves including a connecting duct formed therewithin for directly outputting the air output from the outlet of the second door duct to the return duct of the division unit through the connecting duct.

20. The cold air circulation device of claim 17, wherein the second door duct further includes holes formed at a middle portion of the second door duct for receiving the circulated air through the holes.

* * * * *